United States Patent [19]

Holt

[11] 4,313,546

[45] Feb. 2, 1982

[54] CONTAINER

[75] Inventor: William G. Holt, Lakeville, Mass.

[73] Assignee: Hercules Incorporated, Wilmington, Del.

[21] Appl. No.: 217,714

[22] Filed: Dec. 18, 1980

[51] Int. Cl.[3] ....., B65D 6/34; B65D 8/04; B65D 8/06

[52] U.S. Cl. ..... 220/74; 215/1 C

[58] Field of Search ..... 220/74, 306; 215/1 C, 215/224; 150/0.5

[56] References Cited

U.S. PATENT DOCUMENTS

| | | | |
|---|---|---|---|
| 3,191,225 | 10/1962 | Polka | 18/5 |
| 3,194,857 | 6/1962 | White | 264/94 |
| 3,207,822 | 8/1962 | Makowski | 264/94 |
| 3,621,529 | 12/1969 | Kovacs | 18/5 |
| 3,788,829 | 11/1968 | Miner et al. | 65/79 |
| 3,977,563 | 6/1975 | Holt | 220/206 |
| 4,071,156 | 1/1978 | Lowe | 215/224 |
| 4,076,484 | 2/1978 | Armour et al. | 425/525 |
| 4,086,315 | 8/1976 | Piotrowski | 264/97 |

*Primary Examiner*—George T. Hall
*Attorney, Agent, or Firm*—George H. Hopkins

[57] ABSTRACT

An improved container is provided in which a gap in the uppermost circumferential reinforcing rib in an annular injection molded mouth portion will accommodate manual removal of a lid without the need for a tool.

6 Claims, 1 Drawing Figure

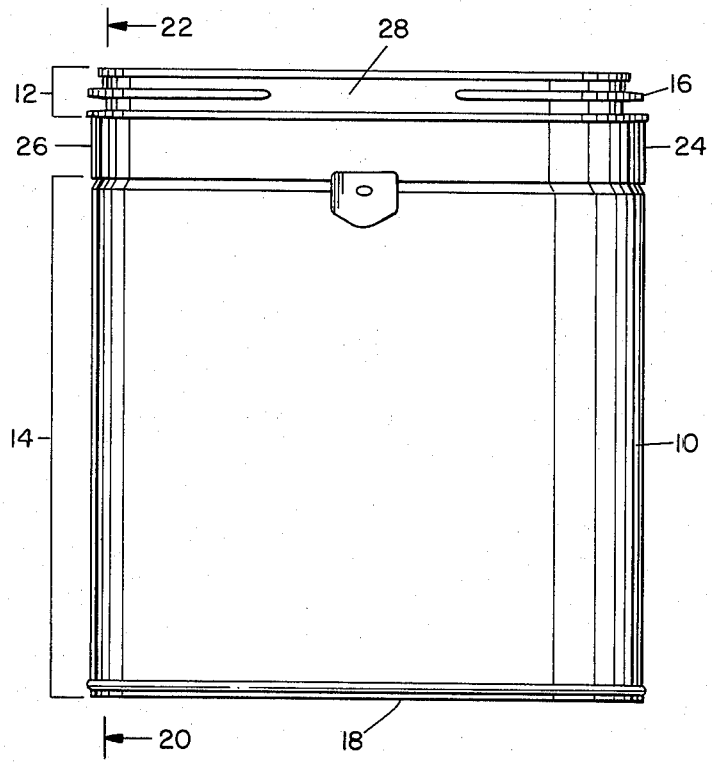
22
28
12
16
26
24
14
10
20
18

CONTAINER

BACKGROUND OF THE INVENTION

Injection blow molding machines, such as disclosed in U.S. Pat. No. 4,076,484 having the same assignee as the present invention, are well known in the art for forming hollow articles, particularly containers of various sizes and shapes. Thermoplastic materials such as polypropylene or polyethylene are heated to a molten, semi-fluid state and are injected into the cavity of an injection mold to form a parison over a removable core or parison pin. Before the material has had an opportunity to completely set, the parison thereon is removed from the injection mold and transferred to a blow mold where pressurized gas or air is blown through the pin to the interior of the parison. This gas causes the parison to expand outwardly in the larger cavity of the blow mold. The expanded parison takes the shape of the blow mold cavity corresponding to a desired shape of the article, and is allowed to set sufficiently to retain that shape thereafter.

In containers of the kind envisioned in the present invention, a highly detailed mouth area is injection molded integrally with a parison portion. The parison portion is then blow molded to the dimensions of the body portion of the finished container. In doing so, a transitional surface is formed between the injection molded mouth area and the larger diameter body portion, which appears as an annular groove on the outside surface of the container just below the mouth area. A container of this kind is illustrated in FIG. 1 of my U.S. Pat. No. 3,977,563.

In such containers, there is a requirement for high hoop strength in the mouth area. For this reason, one or more reinforcing ribs have previously been provided as features of the detail of high definition in the injection molded mouth area. The necessity for the provision of such ribs has limited the utility of such containers in that they can only be opened with the aid of a tool. Like the conventional metal containers for paint and the like, a bladed tool such as a conventional screwdriver or putty knife must be used to pry up a lid affixed to the container. Not only is such a requirement often inconvenient for the user, such a metal tool may easily damage the seal area, causing leakage on resealing. This is particularly disadvantageous if the pail is to be used for mixing color tints or the like on a mechanical shaker.

In my copending U.S. patent application Ser. No. 186,675, filed Sept. 12, 1980, I have disclosed a container in which an annular depending skirt has been provided as a feature of the detail of high definition in the injection molded mouth area. This depending skirt provides an outside wall over the transitional surface formed between the injection molded mouth area and the larger diameter blown body portion. This additional feature allows the use of such containers on conventional labeling and bailing machinery interchangeably with conventional containers. In addition, it was recognized that this additional feature increased the wall strength in the region of the transitional surface between the injection molded preform and the blown parison.

It is an object of the present invention to provide a container from which an affixed lid may be removed without the use of a tool.

The objects, features, and advantages of the present invention are pointed out with particularity in the claims annexed to this specification. Further, they will become more apparent in light of the following detailed description of the preferred embodiment thereof and as illustrated in the accompanying drawing.

SUMMARY OF THE INVENTION

The present invention relates to a container formed by blow molding the parison portion of an injection molded preform.

According to the present invention, there is provided in a container having an injection molded annular mouth portion having detail of high definition, including at least one circumferential reinforcing rib, a generally cylindrical body portion blow molded from a parison portion injection molded integrally with the mouth portion, said body portion having a closed bottom and an inside diameter slightly larger than the inside diameter of the mouth portion, an annular reinforcing region joining the mouth portion to the body portion and forming a transitional surface therebetween, an annular depending skirt provided as a feature of the detail of high definition in the injection molded annular mouth portion, which depending skirt provides an outside wall over said reinforcing region, an improvement comprising at least one gap in the uppermost circumferential reinforcing rib whereby manual removal of an attached lid can be accommodated without the need for a tool.

BRIEF DESCRIPTION OF THE DRAWING

The drawing shows a container of the present invention.

DETAILED DESCRIPTION OF THE DRAWING

The drawing shows a container similar to the disclosed in my copending U.S. patent application Ser. No. 186,875, filed Sept. 12, 1980, but embodying the additional teaching of the present invention. The teachings of my earlier application, Ser. No. 186,875, are herein incorporated by reference as if they were fully set forth herein.

The drawing shows a container (10) formed from a suitable thermoplastic material, such as polyethylene or polypropylene. The container (10) has an injection molded annular mouth portion (12) and a generally cylindrical body portion (14). The mouth portion (12) is injection molded to provide detail of high definition, including at least one circumferential reinforcing rib (16). The body portion (14) is blow molded from a parison portion (not shown) which was injection molded integrally with the mouth portion (12). The body portion (14), when formed, has a closed bottom (18) and an inside diameter (20) which is slightly larger than the inside diameter (22) of the mouth portion (12).

As seen in the drawing, there is an annular depending skirt (24) between the mouth portion (12) and the body portion (14). This depending skirt provides an outside wall (26) over the transitional surface which joins the mouth portion (12) and the body portion (14).

In my copending application, Ser. No. 186,875, it was recognized that the provision of such an outside wall (26) added a greater degree of wall strength in the area of the transitional surface. This is particularly true of containers in which such an outside wall is provided with the additional features shown in the alternate embodiments of that application. It has now been found that this feature also provides additional strength in the area of the mouth portion (12). In fact, it has been found that although a circumferential reinforcing rib such as the one shown as (16) in the drawing is still advantageous, it is not a requirement.

In such a container as that previously described, it is now possible to provide at least one gap (28) at some point along the circumference of the uppermost reinforcing rib (16). This gap (28) is large enough to accommodate the width of two or three of the user's fingers which can then grip a point on the edge of an affixed lid (not shown). By applying pressure to lift the lid at this point of the circumferential gap, the lid may be removed without the need for prying with a bladed tool, such as a conventional screwdriver, putty knife or the like. It should be apparent that more than one gap could be provided, such as one on each side of the container. However, the object of the invention is provided by one such gap, and the provision of multiple gaps, or the removal of the rib entirely would needlessly decrease the strength of the mouth portion without adding any additional utility.

Thus, the container of the present invention provides a clear advantage over the prior art in that no tool is required for removing an affixed lid. In addition, the gap provided as a finger opening slot is recessed from the outermost diameter of the container and protected by the reinforcing rib (16) and the outside wall (26). In this manner, an affixed lid is protected from accidental removal caused by side-to-side movement of such containers during shipment or similar handling, whereas a protruding pry-off tab would not offer similar protection.

The present invention is further advantageous in that the lid may be affixed or removed without the requirement of a specific container orientation. Other features, advantages and specific embodiments of this invention will become readily apparent to those exercising ordinary skill in the art after reading the foregoing disclosures. These specific embodiments are within the scope of the claimed subject matter unless expressly indicated to the contrary. Moreover, while a specific embodiment of this invention has been described in considerable detail, variations and modifications of this embodiment can be effected without departing from the spirit and scope of this invention as disclosed and claimed.

What I claim and desire to protect by Letters Patent is:

1. In a container comprising:

an injection molded annular mouth portion having detail of high definition, including at least one reinforcing rib, a generally cylindrical body portion blow molded from a parison portion injection molded integrally with the mouth portion, said body portion having a closed bottom and an inside diameter slightly larger than the inside diameter of the mouth portion, an annular reinforcing region joining the mouth portion to the body portion and forming a transitional surface therebetween, an annular depending skirt provided as a feature of the detail of high definition in the injection molded annular mouth portion, which depending skirt provides an outside wall over said reinforcing region, in which the improvement comprises:

at least one gap in the uppermost reinforcing rib whereby manual removal of an attached lid can be accommodated without the need for a tool.

2. The container of claim 1 further comprising as an element of the high definitional detail injection molded into the mouth portion, a plurality of ribs on the interior surface of the depending skirt extending inward a short distance in the radial direction and having the transitional surface of the finished container meet the inner periphery of said ribs.

3. The container of claim 1 further comprising as an element of the high definitional detail injection molded into the mouth portion, a plurality of ribs on the interior surface of the depending skirt extending inward a short distance in the radial direction and having the inner periphery of said ribs anchored in the thermoplastic material forming the transitional surface.

4. The container of claim 1 further comprising as an element of the high definitional detail injection molded into the mouth portion, two bail ears on the depending skirt.

5. The container of claim 4 further comprising as an element of the high definitional detail injection molded into the mouth portion, a plurality of ribs on the interior surface of the depending skirt extending inward a short distance in the radial direction and having the transitional surface of the finished container meet the inner periphery of said ribs.

6. The container of claim 4 further comprising as an element of the high definitional detail injection molded into the mouth portion a plurality of ribs on the interior surface of the depending skirt extending inward a short distance in the radial direction and having the inner periphery of said ribs anchored in the thermoplastic material forming the transitional surface.

* * * * *